United States Patent [19]

Lenack et al.

[11] Patent Number: 4,938,891

[45] Date of Patent: Jul. 3, 1990

[54] AQUEOUS FLUIDS

[75] Inventors: Alain L. P. Lenack, Bonsecours; Fernand J. Kech, Mont-Saint-Aignan, both of France

[73] Assignee: Exxon Chemical Patents Inc., Linden, N.J.

[21] Appl. No.: 378,881

[22] Filed: Jul. 12, 1989

Related U.S. Application Data

[63] Continuation of Ser. No. 89,870, Aug. 27, 1987, abandoned.

[30] Foreign Application Priority Data

Sep. 1, 1986 [GB] United Kingdom ..... 86-21093

[51] Int. Cl.[5] ..... C10M 173/02

[52] U.S. Cl. ..... 252/49.3; 252/77; 72/42

[58] Field of Search ..... 252/49.3, 49.5, 77

[56] References Cited

U.S. PATENT DOCUMENTS

| | | | |
|---|---|---|---|
| 3,371,047 | 2/1968 | Brunel | 252/49.5 |
| 4,105,783 | 8/1978 | Yu et al. | 424/283 |
| 4,197,316 | 4/1980 | Yu et al. | 424/317 |
| 4,363,815 | 12/1982 | Yu et al. | 424/274 |
| 4,434,066 | 2/1984 | Lewis | 252/49.3 |

*Primary Examiner*—William R. Dixon, Jr.
*Assistant Examiner*—Ellen M. McAvoy
*Attorney, Agent, or Firm*—Robert A. Maggio; Vivienne T. White

[57] ABSTRACT

Aqueous fluids having a good combination of anti-bacterial properties, stability in hard water, a reduced foaming tendency in soft water and at times a reduced boron content are obtained by the use as additive of a combination of a water-soluble hydroxy di- or tri- carboxylic acid an an excess of an alkanolamine, additive concentrates for incorporation into the aqueous fluids and the aqueous fluids themselves.

5 Claims, No Drawings

AQUEOUS FLUIDS

This is a continuation, of application Ser. No. 89,870, filed Aug. 27, 1987 which is based on U.K. patent application U.K. No. 8621093 filed Sept. 1, 1986 abandoned.

The present invention relates to aqueous fluids and additives and additive concentrates for incorporation into such fluids, such fluids finding use as metal working lubricants and coolants and hydraulic transmission fluids. In particular, the invention is concerned with fluids that can employ hard or soft water.

Aqueous metal working fluids have been known for many years and different additives have been developed to provide fluids useful for different types of metal working and for use with different types of water.

For example, it is known that salts of long-chain alkylsulphonamidocarboxylic acids have an emulsifying and corrosion-inhibiting effect when used in metal processing. Compounds of this type, which are described in German Pat. No. 900041, are generally obtained in admixture with the starting hydrocarbon because of their preparation method, and they are mainly applied in the form of oils. For reasons of the sensitivity of such emulsions to foreign salts, elevated temperature and germ infection, oil-free metal processing agents have been developed such as those described in United Kingdom Pat. No. 1298672 and German Offenlegungsschrift No. 1771548. However, these water-soluble metal processing agents, although being free from the drawbacks of the emulsions, display an insufficient activity especially in hard water; precipitation of calcium salts provokes formation of sticky deposits on the machines and results in depletion of active substances in the solution.

For improving the corrosion-proofing effect, sodium nitrite has often been added to the fluids. However, because of the toxicity problems and the risk of formation of the carcinogenic nitrosamines from the nitrite and the amines contained in many corrosion inhibitors, such additives are not widely used.

It is also known from, for example, U.S. Pat. Nos. 2,999,564, 3,764,593, 3,769,214 and 4,400,284, that mixtures of boric acid and alkanolamines, to which fatty having from 18 to 22 carbon atoms are optionally added; yield water-soluble metal working fluids; boric acid providing resistance to bacteria formation. However, apart from an insufficient corrosion-inhibiting effect, these fluids have the disadvantage of foaming during use. It has also been proposed in U.S. Pat. No. 3,371,047 and United Kingdom Pat. No. 1,345,593 that salts of the alkanolamines and hydroxy carboxylic acids, such as citric acid, tartaric acid may be used optionally together with boron containing compounds in coating formulations using an excess of acid relative to the alkanolamine are useful corrosion inhibitors in colloidal aqueous lubricants and hydraulic transmission fluids.

U.S. Pat. No. 4,129,509 suggests that the use of metal tartrates and citrates is a convenient way of introducing metal ions into an oil water emulsion useful as a cutting fluid.

It has also been proposed that piperazine derivatives formed in a condensation reaction at elevated temperature from amino-alcohols, boric acid and carboxylic acids, be used as corrosion inhibitor, cooling, lubricating and cutting agent (German Pat. No. 1,620,447). However, their corrosion-inhibiting action is not superior to that of the hitherto known products.

Whilst many metal working fluids containing the additives of the type described above have been satisfactory and have been accepted commercially, there is still need for additives which may be used in hard or soft water having good stability in hard water, a low foaming tendency when soft water is used, good bio-stability and a sufficiently low pH. In addition from an environmental standpoint, there is a need to reduce or eliminate the boron content of aqueous fluids.

There is also a need for additives for aqueous hydraulic fluids such as those used in many mechanical operations where although foaming is less critical than in metal working, it is still a problem to be solved. Good bio-stability and hard water compatibility is important especially in applications such as hydraulic supports for roofs in mines so that a stable fluid can be formed with the water that is naturally available on site which can be very hard containing large amounts of calcium.

We have now found according to the present invention that aqueous fluids having a good combination of anti-bacterial properties, stability when hard water is used, a reduced foaming tendency when soft water is used and at times a reduced boron content may be obtained by the use as additive a combination of a water-soluble hydroxy di- or tri- carboxylic acid and an excess of alkanolamine.

The invention also provides additive concentrates for incorporation into aqueous fluids containing a mixture of an excess of alkanolamine and a water soluble hydroxy di- or tri- carboxylic acid optionally together with other additives.

The invention further provides an aqueous fluid containing a mixture of an excess of alkanolamine and a water soluble hydroxyl di- or tri- carboxylic acid optionally together with other additives.

The additives are conveniently supplied to the producer of the aqueous fluids as a concentrate solution of the various additives in water.

Where the fluids of the present invention are to be used for metal working, they may be boron-free although small amounts of boron may be required for the necessary anti-bacterial properties. Boron may be provided by incorporating boric acid or any other boron compound that forms boric acid upon being dissolved in water, such as metaboric acid or boric oxide. It is believed that the boric acid forms an addition product or salt with the amine which is a syrupy liquid and does not precipitate out of the fluid. We prefer that the aqueous metal working fluid contain no more than 1.0, preferably no more than 0.4 wt. % boron.

Examples of hydroxy di- or tri-carboxylic acids which may be used are tartaric and citric acids. It is important that the acid used be soluble in water. We prefer that the additive concentrate contain from 3.0 to 50.0 wt. % of the acid and the aqueous fluid contain from 1.0 to 10 wt. %, more preferably 1.0 to 7 wt. % of the acid.

The alkanolamines used in the present invention, are those which contain from one to three aliphatic radicals, each containing from one to four carbon atoms, and have at least one hydroxy group attached to a carbon atom, and include primary, secondary and tertiary alkylol amines such as mono- di- or triethanolamine. These amines are generally water-soluble and have no offensive odour. The preferred amine for use in preparing the fluid of the invention is diethanolamine, which ordinarily contains minor amounts of mono- or triethanolamine, and has no odour. The alkanolamine should be present in an excess relative to total acid content, i.e. the hydroxyl di- or tri-carboxylic acid together with any boric acid that may be present, we prefer to use a 10 to 20 % molar excess.

A coupling agent such as a non-ionic wetting agent is generally used in aqueous fluids embodying the invention. To improve the compatibility of the components, any desired non-ionic wetting agent may be used, such as a condensation product of ethylene oxide; a condensation product of a fatty acid or derivative, such as a derivative of a fatty acid, fatty alcohol, fatty amide or fatty amine, with ethylene oxide; and a reaction product obtained by the condensation of an oxyalkylaryl compound, such as a derivative of an alkylphenol or alkylnaphthol, with ethylene oxide. It is preferable that the non-ionic wetting agent employed be water-soluble. Typical non-ionic wetting agents include the polyethoxyesters of fatty acids, the monooleate of a polyethylene glycol, the monolaurate of a polyethylene glycol, the polyethoxyethers of fatty alcohols, the condensation product of an alkylphenol such as dodecyl phenol with 12 moles of ethylene oxide, and the sulfonated product of the condensation of an alkylphenol or an alkylnaphthol with ethylene oxide.

A particularly useful non-ionic wetting agent is an alkyl phenoxy polyethoxy ethanol such as octyl or nonyl phenoxy polyethoxy ethanol.

An aqueous fluid embodying the invention may be used in metal working operations and give excellent results in applications in which the pressure per unit of area is relatively low, such as surface grinding operations especially where a number of pieces are being ground simultaneously. For heavier duty applications, such as light cutting operations, in which the pressure per unit of area is higher, an aqueous fluid embodying the invention preferably contains, in addition to the reaction product, antiwear additives such as phosphate esters, sulphurised hydrocarbons and copper passivator such as benzotriazole, tolyltriazole and its derivatives, thiadiazole and dimercapto thiadiazole.

Other ingredients which may be incorporated in the aqueous fluids include silicone anti-foaming agents and biocides.

The hydroxy di- or tri- carboxylic acid used in this invention, together with the alkanolamine, has been found to generally result in improved stability in hard water with reduced precipitation of salts, to give a low foaming tendency in fluids based on soft water, good biostability and to reduce the corrosion due to the fluid. However, use of the composition in soft water can result in some undesirable foaming and the present invention also includes the inclusion of calcium and/or magnesium salts to reduce foaming of soft water systems. The calcium and/or magnesium can be provided by the inclusion of halides, sulphates, sulphonates or carboxylates which may be present in the additive concentrate, or added separately to the aqueous fluid. Conveniently, from 0.01 to 0.5 wt. % of calcium or magnesium is incorporated in the fluid for use in water of hardness lower than 20° French degree TH (corresponding to 200 ppm of calcium carbonate). The improved hard water compatibility is especially useful in the production of hydraulic fluids such as those used in mining operations as for example in the support of roofs where the local water is extremely hard, for example above 500 ppm of calcium carbonate.

In the preparation of an additive concentrate embodying the invention, the ingredients are mixed at ordinary temperatures to produce a water solution. We prefer to first mix the water and the alkanolamine then add the acid and any extreme pressure additives. Preferably the amount of the non-ionic wetting agent is at least 5 percent by weight of the amount of the emulsifier. When an amine salt of a fatty acid is incorporated in the fluid, the amount of the non-ionic wetting agent may be as much as 30 percent by weight of the amount of the emulsifier in order to hold the salt in solution and to prevent the precipitation of a calcium/magnesium soap if the concentrate is to be diluted with hard water.

The ingredients which form an aqueous fluid embodying the invention may be mixed in any desired order, but it is usually convenient to mix the major ingredients to form a liquid of relatively large bulk with which the minor ingredients may be readily mixed.

The additives may be supplied in the form of a concentrate. Typically the concentrates contain from 3.0 to 50 wt. % of the hydroxy di- or tri- carboxylic acid, from 0 to 30 wt. % of boric acid, up to 25 wt. % of alkanolamine and an excess relative to the total acid content, optionally other additives the balance being water. The concentrate may be readily incorporated into bulk water to give the final fluid. Metal working fluids generally contain 1 to 10 wt. % of such a concentrate, preferably 1–5 wt. %.

EXAMPLES

Example 1

The following additive formulation was prepared:

| | |
|---|---|
| Boric Acid | 8.51 wt. % |
| Diethanolamine | 67.16 wt. % |
| Reomet 42 | 0.45 wt. % |
| Tartaric Acid | 13.88 wt. % |
| Water | 10.00 wt. % |

and its anticorrosion properties tested according to the following standard tests and found to be as follows:

| METAL-CORROSION | | | | |
|---|---|---|---|---|
| Test Method | Millings | Plate | Result | Vol % of formulation in water to achieve result |
| IP 125 | Steel | Grey cast iron | 0/0–0 | 3.0 |
| DIN 51360-1 | Steel | Grey cast iron | | 3.5 |
| CNOMO* D63.5200 | Grey cast iron | Steel | 0–0 | 2.0 |
| Grey cast iron millings on filter paper | | | | |
| IP 2B7 | | | Clean paper | 3.0 |
| DIN 51360-2 | | | Rating 0 | 2.5 |

The antifoam performance of the formulations was determined by using the circulating test, CNOMO* D65.5212 procedure with 2% vol. of formulation in 5° TH water. The results were:

| | | |
|---|---|---|
| Time | 300 | minutes |
| Foam tendency | 180 | ml |
| Foam stability (after 15 min) | 0 | ml |
| Stability index | 0 | |

-continued

| | |
|---|---|
| Flow rate | 250 l/h |

IP 312 test using 3% vol of formulation in $CaSO_4$ showing extremely good antifoaming properties.

The gumming properties were also measured in the CNOMO* D651663 test using 2% vol. of the formulation in 20° TH water. The force needed to pull out a ring inserted in the residuum obtained after the evaporation of the water was found to be:

| | |
|---|---|
| Procedure A | 180 N/m |
| Procedure B after dilution with water | 10 N/m |

* Committee De Normalisation De La Machine Outiels as recognised by the French Automobile industry.

We claim:

1. An oil-free additive concentrate adapted for use as metal working lubricants and coolants and hydraulic transmission fluids for incorporation into oil-free aqueous fluids consisting essentially of a mixture of alkanolamine and at least one water soluble carboxylic acid selected from the group amine being present in a stoichiometric excess relative to the carboxylic acid.

2. An additive concentrates according to claim 1 containing from 3.0 to 50.0 wt. % of the acid.

3. An oil-free aqueous fluid adapted for use as metal working lubricants and coolants and hydraulic transmission fluids consisting essentially of at least 90 wt. % water and a mixture of alkanolamine and at least one water soluble carboxylic acid selected from the group consisting of citric acid and tartaric acid, the alkanolamine being present in a stoichiometric excess relative to the carboxylic acid.

4. An aqueous fluid according to claim 3 containing from 1.0 to 10 wt. % of the acid.

5. An aqueous fluid according to claim 4 containing from 1.0 to 7 wt. % of the acid.

* * * * *

UNITED STATES PATENT AND TRADEMARK OFFICE

CERTIFICATE OF CORRECTION

PATENT NO. : 4,938,891

DATED : July 3, 1990

INVENTOR(S) : Alain L. P. Lenack et al.

It is certified that error appears in the above-identified patent and that said Letters Patent is hereby corrected as shown below:

Column 6, line 4, Claim 1, after "group" insert --consisting of citric acid and tartaric acid, the alkanol--.

Signed and Sealed this

Twenty-fifth Day of June, 1991

*Attest:*

HARRY F. MANBECK, JR.

*Attesting Officer*

*Commissioner of Patents and Trademarks*